United States Patent [19]

Waldron

[11] Patent Number: 4,589,134

[45] Date of Patent: May 13, 1986

[54] PERSONAL SOUND SYSTEM

[76] Inventor: Michael J. Waldron, 76 Black Rock Rd., Yardley, Pa. 19067

[21] Appl. No.: 553,649

[22] Filed: Nov. 21, 1983

[51] Int. Cl.[4] ..... H04R 1/02; H04R 5/00

[52] U.S. Cl. ..... 381/90; 381/24

[58] Field of Search ..... 179/157, 107 R; 381/90, 381/24; 455/100, 89

[56] References Cited

U.S. PATENT DOCUMENTS

| | | | |
|---|---|---|---|
| 2,156,504 | 5/1939 | Liss | 179/107 R |
| 2,285,083 | 6/1942 | Cover, Sr. | 455/100 X |
| 2,676,738 | 4/1954 | Herrick | 179/107 R X |
| 3,114,105 | 2/1962 | Neumiller | 455/89 |
| 3,868,573 | 2/1975 | Holcomb et al. | 179/157 X |
| 4,070,553 | 1/1978 | Hass | 179/157 |
| 4,084,139 | 4/1978 | Jakobe | 381/4 |
| 4,485,276 | 12/1984 | Sato | 179/157 |
| 4,539,700 | 9/1985 | Sato | 381/90 |

*Primary Examiner*—Thomas W. Brown

*Attorney, Agent, or Firm*—Howson and Howson

[57] ABSTRACT

A personal stereophonic sound system is disclosed. The sound system includes a garment having a pocket located adjacent to each shoulder for receiving a pair of speakers and a sound signal producing device carried in another pocket. Wires having connectors at opposite ends are sewn into the garment and are releasably connected to the speakers and signal producing device to afford their ready removal for cleaning the garment.

1 Claim, 2 Drawing Figures

PERSONAL SOUND SYSTEM

FIELD OF THE INVENTION

The present invention relates to personal sound systems, and more particularly, the present invention relates to personal stereophonic sound systems particularly suited for use while engaging in various activities.

BACKGROUND OF THE INVENTION

In recent years, several personal sound systems have been marketed for use by people engaging in various outdoor activities such as jogging, hiking, skiing, bicycling, and the like. A well-known system includes a radio or tape recorder adapted to be fastened to a person's belt, and a set of earphones connected by wires to the radio or tape player. While such a system has the advantage of providing high quality stereophonic sound for the user, it has the disadvantage of blocking out ambient sounds. As a result, some people, such as joggers using such systems have been involved in accidents because of their inability to hear the sound of approaching vehicles. Hence, such systems are not entirely satisfactory from a safety standpoint.

Other systems are available which overcome some of the aforementioned safety problems by eliminating the earphones; however, they tend to be cumbersome and less than entirely comfortable to wear. An example of a personal sound system which does not utilize earphones is disclosed in U.S. Pat. No. 4,084,139.

Another such sound system is built into a scarf adapted to be worn about a person's neck. Still another sound system includes speakers adapted to clip onto a person's garments. Miscellaneous other portable communication systems are disclosed in U.S. Pat. Nos. 2,285,083 and 3,114,105. While any of these systems may function satisfactorily for its intended purpose there is a demand for a portable stereophonic sound system which provides high quality sound and which is comfortable and safe to use in a wide variety of activities.

OBJECTS OF THE INVENTION

With the foregoing in mind, a primary object of the present invention is to provide a novel personal sound system particularly suited for use in a wide variety of activities.

Another object of the present invention is to provide an improved portable personal stereophonic sound system which provides quality sound without blocking ambient sounds such as produced by approaching vehicles.

A further object of the present invention is to provide a novel personal sound system which is built into a garment in such a manner as to enable portions of it to be removed and replaced readily to afford cleaning of the garment.

Yet another object of the present invention is to provide a fashionable garment which is specifically designed to carry a readily removable sound system composed of conventional components, thereby providing a unique combination of warmth, sound, comfort and safety.

A still further object of the present invention is to provide a personal sound system which is particularly suited for use by people who may require communications and the use of both hands while engaged in various activities, such as physicians, policemen, firemen, factory workers, and the like.

SUMMARY OF THE INVENTION

More specifically, the present invention provides a personal sound system which includes a fashionable garment with built-in removable speakers and a sound producing unit. The garment is adapted to be worn about a person's torso and has a pair of pockets located adjacent to the person's shoulders for receiving a pair of speakers. The sound producing unit is contained in another pocket located elsewhere in the garment. Wires are sewn into the garment and have connectors at their ends to releasably connect the sound producing unit to the speakers. The connectors afford ready disconnection and removal of the speakers and sound unit to enable the garment to be cleaned.

BRIEF DESCRIPTION OF THE DRAWINGS

The foregoing and other objects, features and advantages of the present invention should become apparent from the following description when taken in conjunction with the accompanying drawing, in which.

DESCRIPTION OF THE PREFERRED EMBODIMENT

Figure 1:
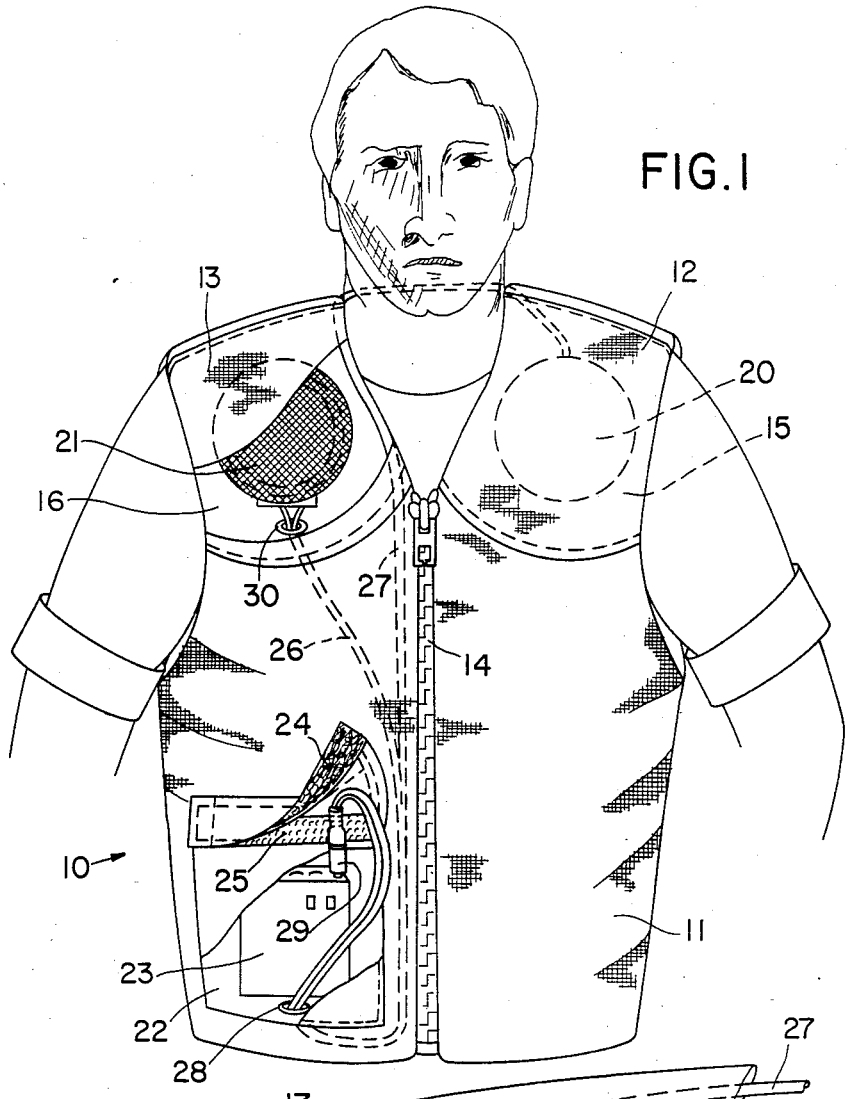
FIG. 1 is a front elevational view of a personal sound system embodying the present invention, portions being broken away to expose certain details of construction.

Referring now to the drawings, FIG. 1 illustrates a personal sound system 10 embodying the present invention. The personal sound system 10 comprises a garment 11 adapted to be worn about a person's torso and means carried by the garment for emitting sounds such as music. In the illustrated embodiment, the garment 11 is a vest which embraces a person's neck, chest and back. The vest 11 has right and left portions 12 and 13, respectively depending from the shoulders and over both clavicles and a front zipper 14. The vest 11 may be fabricated of any of a number of conventional materials and is preferably insulated. While the illustrated garment 11 is a vest, it should be apparent that the present invention should not be regarded as limited to a vest, since it may be incorporated into other garments such as coats, jackets, sweaters, and the like.

Figure 2:
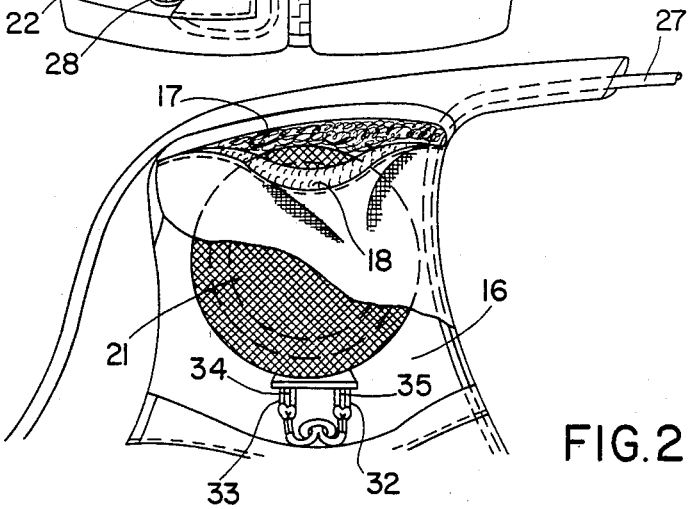
FIG. 2 is an enlarged fragmentary view of the garment component of the present invention with one of its pockets broken away to expose the speaker and its releasable connectors.

The garment 11 is specially designed to incorporate a stereophonic sound system. To this end, the garment 11 is provided with a pair of fabric pockets 15 and 16 which are located in the portions 12 and 13 of the garment which depend across the front of the person's clavicles between the chest and the shoulder. The pockets 15 and 16 are open at their upper ends but are provided with releasable closures such as the cooperating strips of Velcro hooks and pile 17 and 18 which function in a well known manner to releasably close the pockets. See FIG. 2.

A speaker is contained in each of the pockets. The speakers 20 and 21 are disposed therein with their diaphragms facing frontward so that sounds produced by the speakers 20 and 21 are transmitted through the fabric pockets in a generally forward and slightly upward direction toward the wearer's ears. While a pair of speakers 20 and 21 are provided, one for each pocket, to provide stereophonic sound, it should be apparent that a single pocket with a single speaker may be utilized should the advantages of a stereo system not be desired.

The speakers 20 and 21 are energized by a sound signal producing unit carried by the garment 11. For this purpose, the garment 11 is provided with a third pocket 22 remote from the pair of pockets 15 and 16, and the signal producing unit 23 is contained therein. In the illustrated embodiment, the signal producing unit is a conventional battery-operated AM-FM radio receiver. It should be understood, however, that a tape cassette player may be utilized in lieu of the radio 23 to produce the sound signal for the speakers 20 and 21. Preferably, the third pocket is releasably closed by cooperating Velcro strips 24 and 25. See FIG. 2.

To transmit the sound signal produced by the sound unit, wires 26 and 27 are sewn into the garment and are connected at opposite ends to the unit 23 and the speakers 20 and 21. As best seen in FIG. 1, the lower end portions of the wires enter the third pocket 22 through a grommet 28 provided in the fabric and terminate in a plug 29 providing a releasable connection to the sound producing unit 23. From the third pocket 22 the wires 26 and 27 extend upwardly inside the garment 11 to enter the pockets 15 and 16 through grommets, such as the grommet 30 in the pocket 16. The wire 27 for the left speaker 20 extends around the upper portion of the garment 11 behind the person's neck as illustrated. Thus, the wires 26 and 27 are contained completely within the garment and are permanently secured thereto. If desired, other means may be provided to transmit a signal from the sound unit 23, including so-called wireless transmission systems.

The speakers 20 and 21 and sound unit 23 are removable to afford cleaning of the garment 11. For this purpose, the upper ends of the wires 26 and 27 are provided with female connectors such as the connectors 32,33 illustrated on the right speaker 21 in FIG. 2. The female connectors 32,33 releasably engage male connectors 34,35 on each speaker. See FIG. 2. The connectors slidably mate with one another so they can be engaged and disengaged readily simply by pushing or pulling the same relative to the speakers.

In use, the speakers 20 and 21 and sound unit 23 are arranged in the garment 11 in the manner illustrated in FIG. 1. If the sound unit is a radio, it can be tuned readily simply by reaching inside the pocket and turning the appropriate knob. In a similar manner, the volume of the sound produced by the speakers 20 and 21 can be controlled. Because the speakers are located adjacent to the wearer's shoulders, the sound produced is directed toward the wearer's ears so that it can be heard readily; however, since no earphones are used, ambient background noise can still be heard. Hence, the garment is safe to wear because the user is able to hear traffic and approaching vehicles.

To clean the garment, the pockets 15 and 16 containing the speakers 20 and 21 are opened, and the speakers disconnected from the wires 26 and 27. The sound unit 23 is also unplugged from the connecting wires 26 and 27. The wires 26 and 27 remain in the garment during laundering; however, because of their flexibility, they can withstand the twisting and tumbling stresses to which the garment 11 is subjected. After cleaning, the speakers and sound unit can be hooked up quickly and easily to again place the personal sound system in condition for use.

The personal sound system of the present invention has a number of uses. For instance, it may be used by police and firemen under emergency conditions when they need to receive communications yet be able to hear ambient sounds, in which event the sound producing unit preferably is one capable of receiving appropriate radio frequency signals. The personal sound system may also be incorporated into the coats worn by physicians, in which event the sound producing unit may be part of a paging system. Furthermore, the personal sound system of the present invention may be used, as disclosed, by factory workers who like to listen to music while working but must also be able to hear ambient sounds for their own safety.

In view of the foregoing, it should be apparent that the present invention has now provided an improved personal stereophonic sound system which is fashionable to wear, safe to use and easy to clean.

While a preferred embodiment of the present invention have been described in detail, various modifications, alterations and changes may be made without departing from the spirit and scope of the present invention as defined in the appended claims.

I claim:

1. A personal sound system, comprising:

a garment adapted to substantially entirely cover a person's upper torso, said garment having portions encircling the person's neck and depending forwardly and rearwardly from the person's right and left shoulders.

a pair of fabric pockets located in said forwardly depending portions of said garment adjacent to the person's neck and shoulders, a releasable closure extending along upper portions of each pocket, a third pocket in said garment below said pair of pockets, flexible wires sewn into said garment and extending between said third pocket and said pair of pockets, said wires having opposite end portions extending into each of said pockets, releasable connectors mounted on said end portions of said wires, a speaker adapted to be contained in each of said pair of pockets and having connectors releasably connected to corresponding ones of said releasable connectors, and signal producing means adapted to be contained within said third pocket and having a connector releasably connected to a corresponding one of said releasable connectors, whereby the garment provides warmth for the torso and the signal producing means cooperates with the wires to cause sound to be emitted from the speakers adjacent the person's ears while the releasable connectors afford ready removal of the speakers and signal producing means for cleaning the garment.

* * * * *